US006164271A

United States Patent [19]

Paulson et al.

[11] Patent Number: 6,164,271

[45] Date of Patent: Dec. 26, 2000

[54] BALL THROWING MACHINE AND ELECTRICAL CONTROL THEREFOR

[75] Inventors: Kerry K. Paulson, Sherwood; James A. Kerr, Hillsboro; Paul A. Heinsch, Portland, all of Oreg.

[73] Assignee: The Jugs Company, Inc., Tualatin, Oreg.

[21] Appl. No.: 09/426,539

[22] Filed: Oct. 26, 1999

[51] Int. Cl.[7] ..... F41B 4/00

[52] U.S. Cl. ..... 124/78

[58] Field of Search ..... 124/6, 78

[56] References Cited

U.S. PATENT DOCUMENTS

| | | | |
|---|---|---|---|
| 3,774,584 | 11/1973 | Paulson | 124/78 |
| 4,197,827 | 4/1980 | Smith | 124/78 |
| 4,760,835 | 8/1988 | Paulson et al. | 124/78 |
| 5,107,820 | 4/1992 | Salansky | 124/78 |
| 5,125,653 | 6/1992 | Kovacs et al. | 124/78 |
| 5,437,261 | 8/1995 | Paulson et al. | 124/78 |
| 5,464,208 | 11/1995 | Pierce | 124/78 X |

*Primary Examiner*—John A. Ricci
*Attorney, Agent, or Firm*—Olson and Olson

[57] ABSTRACT

The ball throwing machine of this invention includes a vertical base plate mounting a wheel support plate for pivotal movement about a pivot axis which defines an arcuate slot in the base plate through which a clamp bolt extends from the wheel support plate. The wheel support plate mounts top and bottom pneumatic tired wheels for rotation to grip a ball between them and project it forward. An electrical control circuit affords adjustment of wheel rotational speed by a single rotary switch and also allows selection of a variety of types of pitches by a single rotary switch. The electrical circuit also provides for the setting of a differential rotational speed between the top and bottom wheels, for optimum quality of pitching control, and also provides for limiting the minimum and maximum wheel rotating speeds to achieve realistic pitching speed range.

13 Claims, 3 Drawing Sheets

BALL THROWING MACHINE AND ELECTRICAL CONTROL THEREFOR

BACKGROUND OF THE INVENTION

This invention relates to ball pitching machines of the type disclosed in U.S. Pat. No. 3,774,584 having common ownership with this invention, and more particularly to an electrical control for selecting a variety of pitching speeds and spin characteristics by two control knobs.

In the U.S. patent referred to above, speed, trajectory and spin characteristics are varied by manual adjustment of voltage delivered to the drive motors of the ball throwing rotary wheels and by varying the angular position of the rotary wheels relative to vertical. These controls require training of personnel and are subject to human errors which can result in the delivery of pitches of undesired speed, type and location.

SUMMARY OF THE INVENTION

The ball pitching machine and control of this invention utilizes an electrical circuit that is capable of delivering pitches of precise speed within usable minimum and safe maximum limits by one control knob and of desired spin characteristics by another control knob.

It is the principal objective of this invention to provide a ball throwing machine and control that overcomes the aforementioned limitations and disadvantages of prior controls.

Another objective of this invention is the provision of a ball throwing machine control of the class described that establishes a minimum usable pitching speed and a maximum safe pitching speed, neither of which is subject to human error.

Still another objective of this invention is to provide a ball throwing machine control of the class described that affords delivery of ball pitches of precise speed and location by selected rotation of a speed control knob.

A further objective of this invention is the provision of a ball throwing machine control of the class described that affords delivery of ball pitches of a variety of types by selective actuation of a single control switch.

A still further objective of this invention is the provision of a ball throwing machine that is of simplified construction for economical manufacture, maintenance and repair.

The foregoing and other objects and advantages of this invention will appear from the following detailed description, taken in connection with the accompanying drawings of a preferred embodiment.

DESCRIPTION OF THE PREFERRED EMBODIMENT

Figure 1:
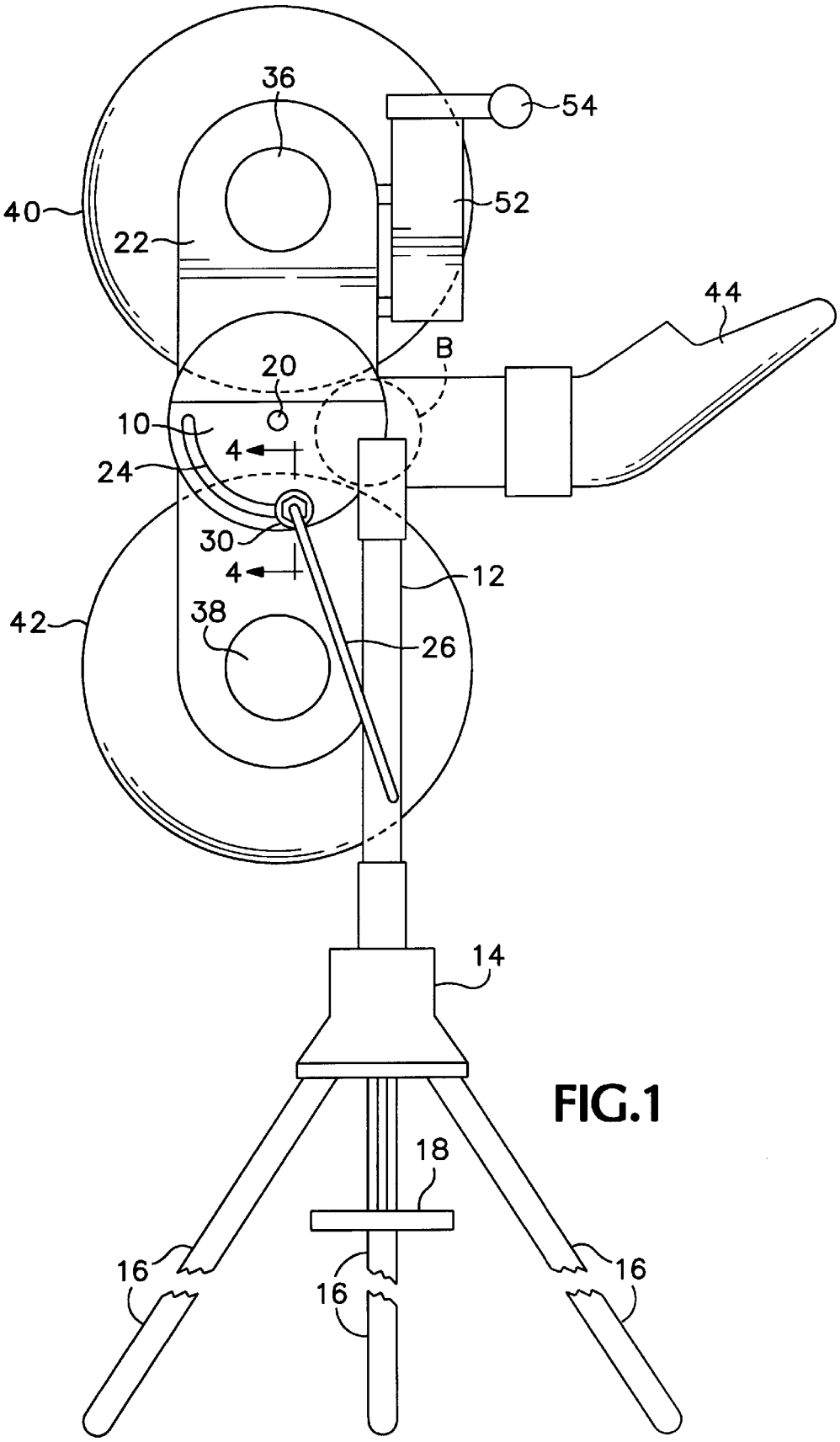
FIG. 1 is a side elevation of a ball throwing machine having associated therewith a control embodying the features of this invention.
Figure 2:
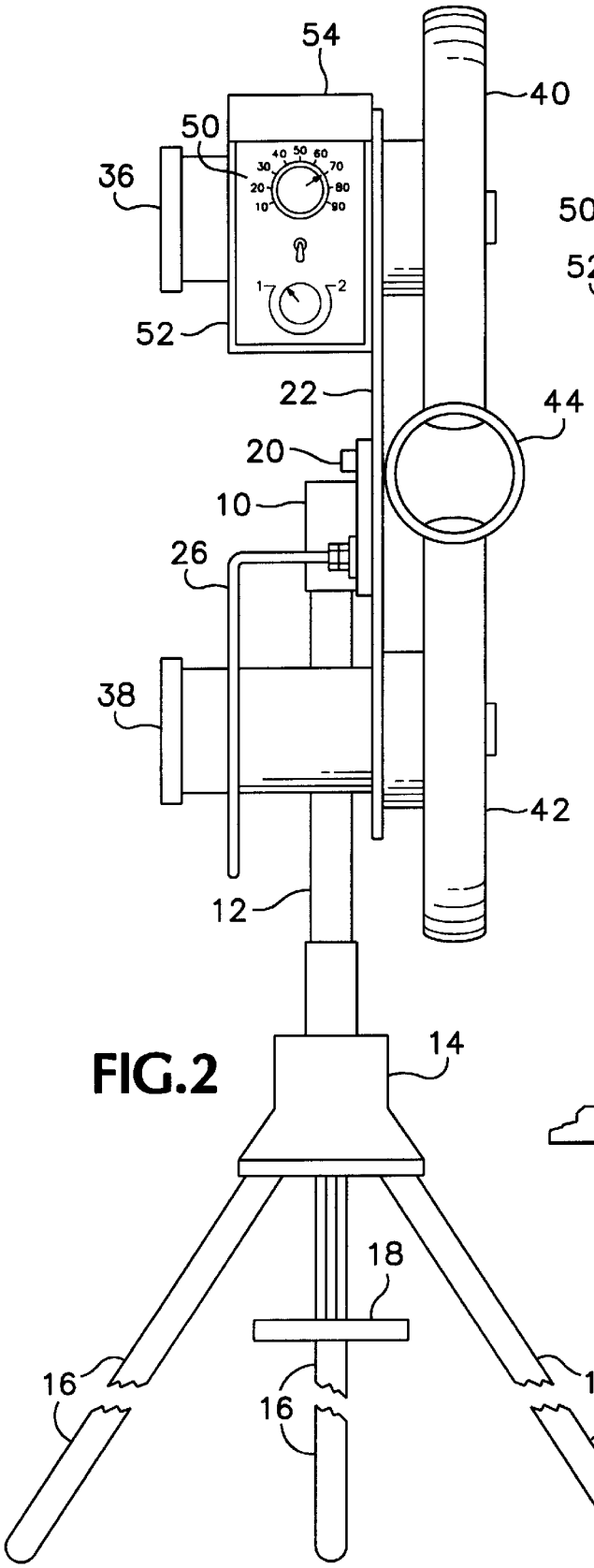
FIG. 2 is a rear elevation as viewed from the left in FIG. 1.

For the purpose of this description, there is illustrated in FIGS. 1 and 2 a ball throwing device in which two rotary wheels are adjustable in relative rotational speeds and in angular displacement relative to vertical, to accommodate the throwing of balls of various horizontal and vertical trajectories.

Briefly, the ball throwing device illustrated includes a main support base 10 secured to the upper end of a vertical pivot post 12 the lower end of which is supported in a socket in body member 14 to which three legs 16 are secured removably by a clamp operated by clamp screw 18 to provide a tripod support for the assembly, as described in U.S. Pat. No. 5,437,261 which has common ownership with this invention.

The base 10 is in the form of a plate. A pivot bolt 20 extends removably through the plate for mounting an elongated wheel support plate 22 for rotation relative to the pivot bolt. An arcuate slot 24 in the base 10 is formed on a radius of the axis of the pivot bolt, and receives slidably therethrough an end portion of an L-shaped handle 26. The end portion is threaded and the terminal end portion thereof is threaded into a threaded bore 28 in plate 22. The handle thus is secured to the plate for limited rotation. A pair of washers 30 on the handle abut the base 10 and a clamp nut 32 abuts the adjacent washer to releasably clamp the plate 22 to the base 10 in any desired position of rotation relative to the base, within the limits of the arcuate slot 24. A lock nut 34 on the threaded portion of the handle is arranged to abut the clamp nut 32 to secure the latter in its adjusted position.

The plate 22 mounts a pair of electric drive motors 36 and 38 at positions spaced diametrically to opposite sides of and at substantially the same distance from the axis of pivot bolt 20. Motor 36 is identified hereinafter as the top motor and motor 38 the bottom motor, for the purpose of the following description. The drive motors mount wheels provided with pneumatic tires 40 and 42. The space between the outer circumferential surfaces of the tires is slightly less than the diameter of a ball B to be delivered from an infeed chute 44 for gripping between the tires and thrown forwardly from the rotating wheels.

Adjustment of the vertical trajectory of a thrown ball is achieved by rotating the handle 26 to loosen the clamp nut 28 and allow rotation of the plate 22. The handle then is rotated to tighten the clamp nut 28 and secure the adjustment against the base plate 10.

The foregoing arrangement of pivotal mounting of pneumatic tires for rotational adjustment about pivot bolt 20, using a flat plate 22, flat base 10 and arcuate guide slot 24 for clamp bolt 28, represents a simplified construction for economical manufacture, maintenance, repair and mode of operation, as compared with the universal ball and socket mounting of the prior art, such as those disclosed in U.S. Pat. Nos. 3,774,584 and 5,437,261 aforesaid.

Figure 3:
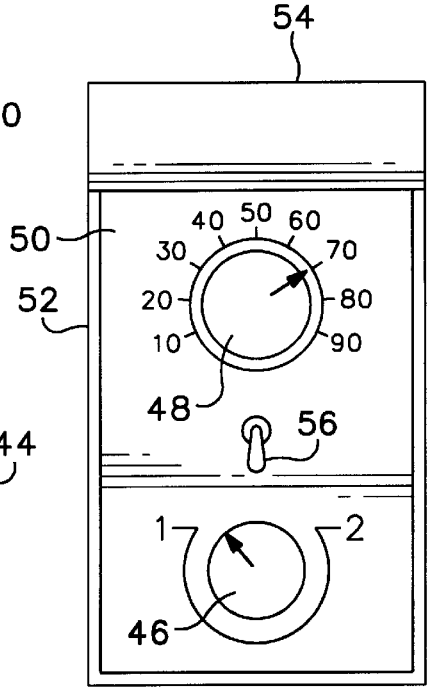
FIG. 3 is a front view, on an enlarged scale of the control cabinet of FIG. 2 housing the electrical control circuitry for the rotary ball throwing wheels shown in FIGS. 1 and 2.
Figure 4:
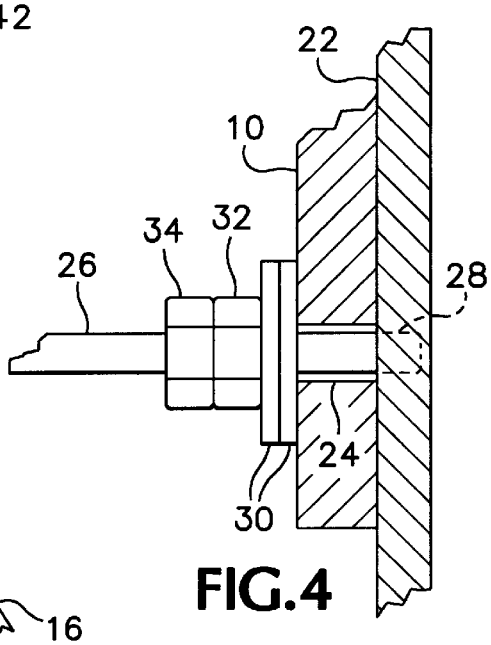
FIG. 4 is a fragmentary sectional view, on an enlarged scale, taken on the line 4—4 in FIG. 1.

This invention also provides a novel electrical control system by which the magnitude and relative speeds of rotation of the tires 40 and 42 are adjusted. This is achieved by the simple expediency of two rotary indexing knobs 46 and 48 mounted on the control panel 50 of a control box 52 secured to the plate 22. A handle 54 is provided on the control box to facilitate manipulation of the wheel support assembly. Knob 46 serves to select the type of pitch of a thrown ball, and knob 48 serves to adjust the speed of a thrown ball, in miles per hour or kilometers per hour. The type of pitch may be a fastball, flyball or pop-up, in the No. 1 position of knob 46 (FIG. 3), or it may be an overhand curve, a split finger pitch or a groundball, in the No. 2 position of the knob. A power switch 56 controls connection of the electrical circuitry to a source 58 (FIG. 5) of electric potential.

Figure 5:
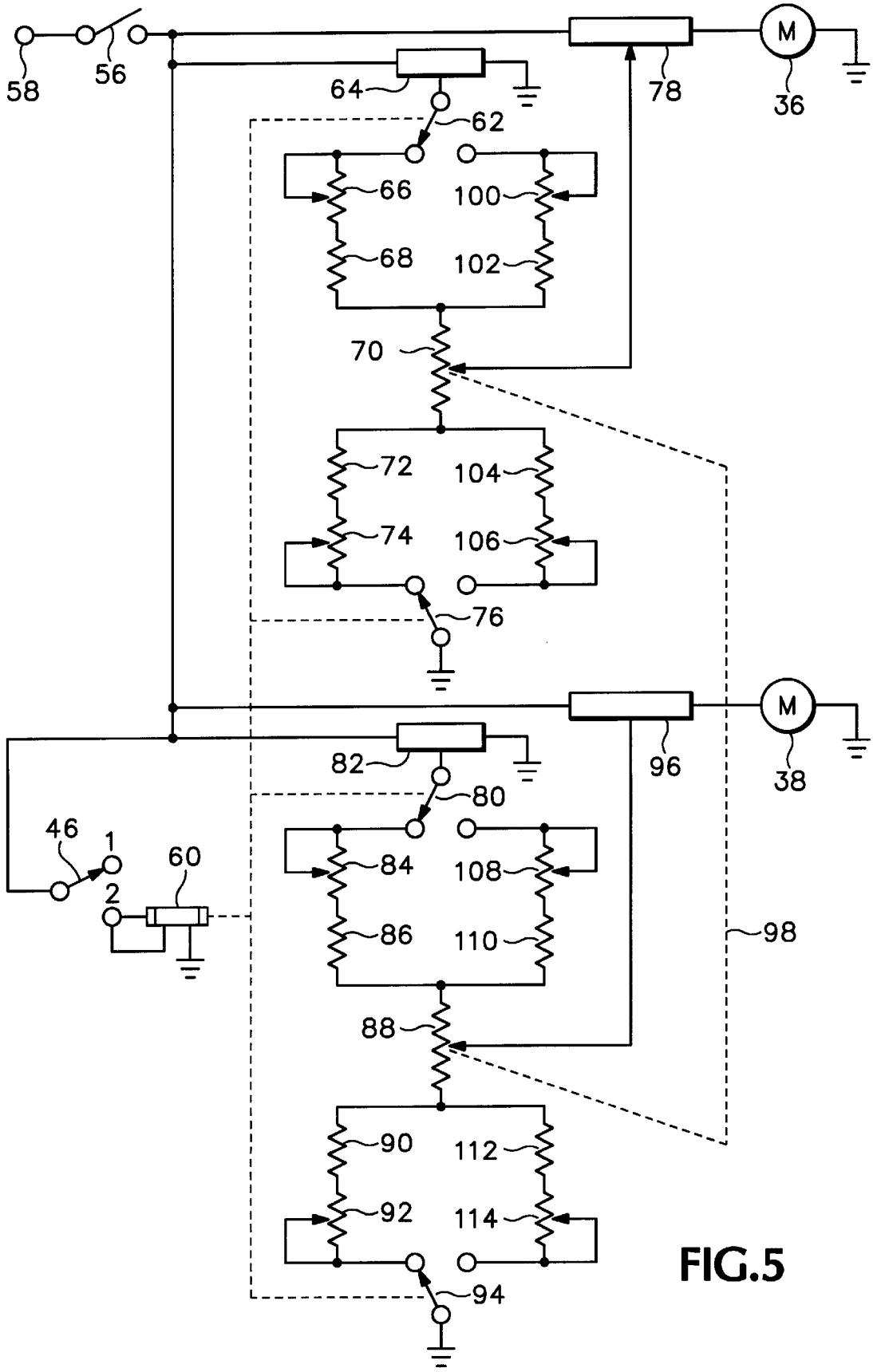
FIG. 5 is a schematic electrical diagram of a control circuit for the electric drive motors of the ball throwing machine shown in FIGS. 1 and 2.

Referring to FIG. 5, the control knob 46 (FIG. 3) serves to control activation of the relay 60 of a 4-pole, double throw switch. When the control knob 46 is in the number 1 position shown in FIG. 5, the normally closed contacts 62 are operative, as follows: A reference voltage from regulated voltage source 64 is applied through the resistor network of a voltage divider circuit formed of trimmer resistor 66, fixed resistor 68, variable resistor 70, fixed resistor 72 and trimmer resistor 74, then through the normally closed relay contacts 76 to ground. This circuit controls the voltage of the motor controller 78 of the top drive motor 36.

In similar manner, with control knob 46 in the number 1 position illustrated, the normally closed contacts 80 connect a reference voltage from regulated voltage source 82 to the resistor network of a voltage divider circuit formed by trimmer resistor 84, fixed resistor 86, variable resistor 88, fixed resistor 90 and trimmer resistor 92, through normally closed relay contacts 94 to ground. This circuit controls the voltage to the motor controller 96 of the bottom drive motor 38.

The voltage drop across resistor 68 and trimmer resistor 66 assures that at its maximum position the wiper of the variable resistor 70 will never achieve the maximum voltage available from the reference voltage supply 64. Thus, the maximum control voltage, and therefore motor speed, will be limited to a desired operating parameter depending upon the resistance value selected for resistor 68. Trimmer resistor 66 is used to adjust for variances in motor and control components.

In like manner, the voltage drop across resistor 72 and trimmer resistor 74 assures that at its minimum position the wiper of the variable resistor 70 will not reach ground potential, or zero volts, and therefore sets the minimum motor speed parameter.

In this regard, it is to be recognized that in the pitching of balls there must be some minimum wheel rotational speed to provide a satisfactory pitch, and there also must be a limit on the high speed at which a pitch becomes unrealistically fast or dangerous.

In the same manner as for top motor 36, the maximum and minimum speeds for the bottom motor 38, and hence tire 42, are set by appropriate selection of resistance values for resistors 86 and 90, respectively, with trimmer resistors 84 and 92 adjusting for variances in motor and control components.

It is to be noted that the movable contacts of variable resistors 70 and 88 are ganged together, as indicated by broken line 98, for simultaneous movement by rotation of index knob 48. Accordingly, both drive motors 36 and 38 will respond simultaneously to the speed settings of the variable resistors. This enables calibration of the speed dial associated with index knob 48, appropriately in miles per hour or kilometers per hour.

It has been determined that best pitching results are obtained when one drive motor 36 or 38 is adjusted to rotate faster than the other, preferably by a differential of about 750 rpm. Accordingly, for an overhand curve ball, for example, the maximum speed for the top wheel 36 is 2150 rpm and the maximum speed for the bottom wheel 38 is 1400 rpm. This is accomplished by setting a lower resistance value for fixed resistor 68 and a higher resistance value for fixed resistance 86. This provides a higher voltage for the top wheel motor 36 than for the bottom wheel motor 38 when variable resistors 70 and 88 are set for maximum rotational speed.

It also has been determined that the speed of a pitched ball of less than 30 miles per hour (48 kilometers per hour) is not useful for realistic practice. Accordingly, at 30 mph the speed of top wheel 36 is 1,000 rpm and the bottom wheel 38 is 250 rpm. With variable resistors 70 and 88 set to minimum position the resistance of fixed resistor 72 is made higher than the resistance of fixed resistor 90 so that the differential speed remains at about 750 rpm.

If it is desired that the ball throwing machine throw a fastball, index knob 46 is rotated to position number 2, whereupon relay 60 is activated and contacts 62, 76, 80 and 94 are switched to the open position. Accordingly, resistors 66, 68, 72, 74, 84, 86, 90 and 92 are switched out and resistors 100, 102, 104, 106, 108, 110, 112 and 114 are made active.

Although the operation previously described obtains for the switched condition, resistors 110 and 112 are provided with lower resistance values than resistors 108 and 104 to enable faster rotation of the bottom wheel 38 than top wheel 36, by a differential of about 750 rpm.

Other pitch characteristics, such as split finger and groundball, with knob 46 set to position number 1, or fly ball and pop-up with knob 46 set to position number 2, are achieved by varying the speed of the pitch and by varying the vertical trajectory of flight of the ball, by loosening clamp nut 32 and rotating plate 22 about the axis of pivot bolt 20. It will be understood that the velocity of a ball thrown by the apparatus varies with the rotational speed and diameter of the wheels 40 and 42.

It will be apparent to those skilled in the art that various changes may be made in the size, shape, type, number and arrangement of parts described hereinbefore, without departing from the spirit of this invention and the scope of the appended claims.

We claim:

1. A ball throwing machine, comprising:

a) a base member arranged for support on the ground, b) a wheel support plate, c) pivot means mounting the wheel support plate on the base member for pivotal adjustment, d) a clamp bolt on the wheel support plate, e) an arcuate slot in the base member having a radius through the pivot means and receiving the clamp bolt for movement therein, f) a clamp nut on the clamp bolt for releasably clamping the wheel support plate to the base member, g) top and bottom electric drive motors mounted on the wheel support plate, h) top and bottom ball throwing wheels secured to the electric drive motors, the outer circumferential surfaces of the wheels being spaced apart less than the diameter of a ball for engaging the latter and projecting it from between the wheels, and i) electric control means operatively connected to the electric drive motors for controlling the rate of rotation of the wheels.

2. The ball throwing machine of claim 1 wherein the electric control means comprises:

a) a source of electric potential, b) motor control means for connecting the source of electric potential to each drive member, c) variable resistor means interconnecting each motor control means and a source of electric potential and operable to very the voltage to said motor control means for varying the rotational speed of the associated drive motor and wheel, and d) voltage divider means operatively associated with each variable resistor means for limiting the maximum and minimum voltage to the associate motor control means and correspondingly limiting the maximum and minimum rotational speed of the associated drive motor and wheel.

3. The ball throwing machine of claim 2 wherein the voltage divider means associated with one drive motor is configured to supply a voltage to said drive motor lower than the voltage to said other drive motor, to provide a predetermined differential of rotational speed between the pair of ball throwing wheels.

4. The ball throwing machine of claim 2 including operating means for connecting together the variable resistor means for both motor control means for simultaneous movement.

5. The ball throwing machine of claim 4 wherein the operating means is a control knob on a control panel supported by the base member.

6. The ball throwing machine of claim 2 including operating means for connecting together the voltage divider means for both motor control means for simultaneous movement.

7. The ball throwing machine of claim 6 wherein the operating means is a control knob on a central panel supported by the base member.

8. In combination with a ball throwing machine wherein each of a pair of ball projecting wheels is rotated by an electric drive motor, an electric control circuit operatively connected to the drive motors for controlling the rate of rotation of the wheels, comprising:

a) a source of electric potential, b) motor control means for connecting the source of electric potential to each drive motor, c) variable resistor means interconnecting each motor control means and a source of electric potential and operable to vary the voltage to said motor control means for varying the rotational speed of the associated drive motor and wheel, and d) voltage divider means operatively associated with each variable resistor means for limiting the maximum and minimum voltage to the associated motor control means and correspondingly limiting the maximum and minimum rotational speed of the associated drive motor and wheel.

9. The combination of claim 8 wherein the voltage divider means associated with one drive motor is configured to supply a voltage to said drive motor lower than the voltage to said other drive motor to provide a predetermined differential of rotational speed between the pair of ball throwing wheels.

10. The combination of claim 8 including operating means for connecting together the variable resistor means for both motor control means for simultaneous movement.

11. The combination of claim 10 wherein the operating means is a control knob on a control panel on the machine.

12. The combination of claim 8 including operating means for connecting together the voltage divider means for both motor control means for simultaneous movement.

13. The combination of claim 12 wherein the operating means is a control knob on a control panel on the machine.

* * * * *